United States Patent [19]

Ødegaard

[11] 4,197,034

[45] Apr. 8, 1980

[54] FLOATING PIER

[75] Inventor: Kristian Ødegaard, Snaroya, Norway

[73] Assignee: Thos. Storey (Engineers) Limited, London, England

[21] Appl. No.: 917,478

[22] Filed: Jun. 21, 1978

[30] Foreign Application Priority Data

Jun. 23, 1977 [NO] Norway ..... 772224

[51] Int. Cl.[2] ..... E02B 3/20

[52] U.S. Cl. ..... 405/219; 405/218

[58] Field of Search ..... 405/219–221, 405/218; 14/1, 6, 7, 27

[56] References Cited

U.S. PATENT DOCUMENTS

| | | | |
|---|---|---|---|
| 712,896 | 11/1902 | Barker | 14/1 |
| 2,842,786 | 7/1958 | Digby-Smith et al. | 14/6 |
| 3,024,753 | 3/1962 | Benson | 14/27 X |
| 3,081,601 | 3/1963 | Fentiman | 405/221 |
| 4,003,209 | 1/1977 | Jackson et al. | 405/218 |

FOREIGN PATENT DOCUMENTS

| | | | |
|---|---|---|---|
| 6612667 | 3/1968 | Netherlands | 405/219 |

*Primary Examiner*—Dennis L. Taylor
*Attorney, Agent, or Firm*—Wood, Herron & Evans

[57] ABSTRACT

A floating pier of the type in which a main pier is supported on transverse cantilever arms with floats, the arms projecting out on both sides of the main pier, characterized in that the bearing members of the main pier and of each cantilever arm are openwork truss beams having a rectangular, trapezoidal or triangular cross-section.

5 Claims, 6 Drawing Figures

FLOATING PIER

The invention relates to a floating pier of the type in which a main pier member is supported by transverse cantilever arms with floats, the arms projecting out on both sides of the main pier.

Embodiments of floating piers are previously known in which the pier rests on floats, and the cantilever arms that extend out on both sides of the main pier are connected to one another to form a very broad structure which is stable in the sea. Most of these structures, however, require a great deal of time to build, and they are not able to withstand the stresses produced by bad weather conditions to which they are exposed. If such known floating piers are exposed to strong winds or rough seas they can easily be affected by torque and will have a tendency to break up after a relatively short time, thus necessitating a great deal of maintenance work. In addition, the structures are not completely safe. The members used to construct the pier are usually not sufficiently rigid to withstand stresses, and it was previously believed that a certain degree of structural flexibility was necessary.

The general object of the present invention is to provide an inexpensive and safe pier structure which can be constructed quickly and whose members are sufficiently rigid to withstand stresses to which they would normally be subjected.

In contrast to previous beliefs the invention has surprisingly demonstrated that a very rigid pier structure may be used and indeed is preferable.

By so positioning the members constituting the cantilever arms and main pier, a maximum number of fastening points is obtained, so that the structure is rendered extremely rigid.

The truss members are preferably of triangular cross-section which may be, of the type mass-produced for the construction industry, so that the members are reasonably priced.

Alternatively the members may be of trapezoidal or rectangular cross-section.

A pier in accordance with the invention having triangular members has the advantage that a sloping, upright board is provided along the longitudinal edges of the main pier itself, resulting in a somewhat "trough-shaped" main deck, a shape which provides increased safety for persons walking on the pier and reduces the risk of objects falling off the edge. At the same time, the longitudinal pipes in the truss beam provide a simple and strong structure for securing moorings.

The invention will now be further described by way of example with reference to the accompanying drawings in which.

Figure 1:
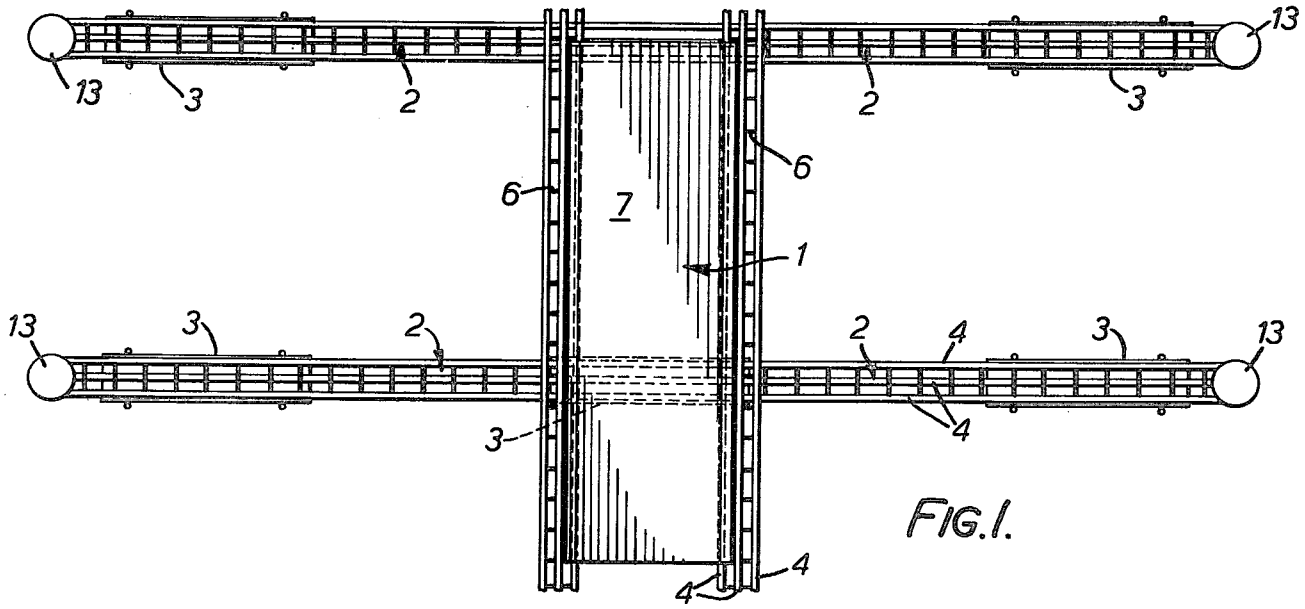
FIG. 1 is a schematic plan view of a portion of one embodiment of a floating pier in accordance with the invention.
Figure 2:
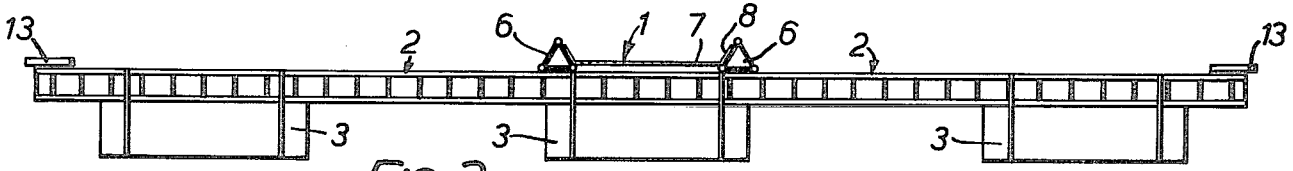
FIG. 2 shows the pier structure of FIG. 1 in an end view.

Referring to the drawings a main pier 1 is positioned above and fastened to a plurality of parallel cantilever arms 2 which extend transversely of and from, both sides of the main pier 1. The cantilevers are supported in the water by floats 3 at the ends of the arms and by a further float 3 under the main pier itself.

Figures 3, 5:
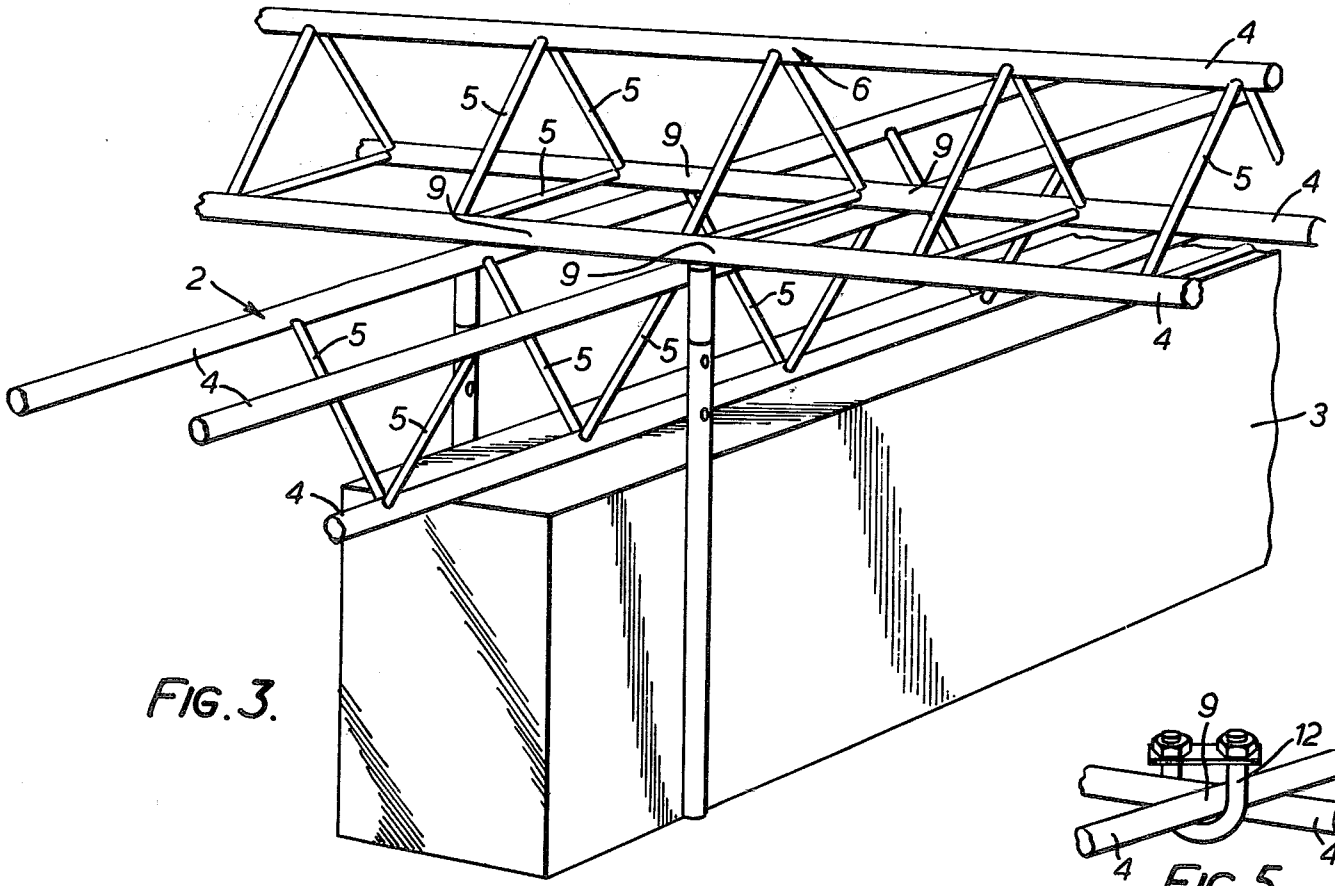
FIG. 3 is a detail drawing showing an intersection between a main pier beam and one of the cantilever arms.
FIG. 5 shows a second fastening means for the beams and cantilevers.

The cantilever arms 2 are truss beam members having a triangular cross-section formed of three tubes 4 connected by struts 5, the apex of the triangle pointing down toward the float, as best seen in FIG. 3. The lowest tube 4 of each of the cantilevers is fastened in a suitable manner to the floats 3. The longitudinal support beams 6 for the main pier are positioned above the transverse cantilevers 2, and are also constructed as truss beam members of triangular cross-section similar to those two described above. The apex of the pier beam triangle pointing up in the opposite direction to that of the cantilever triangle apex. The relative positioning of the two beams 2 and 6 can be seen in FIG. 3.

A deck 7 which forms the walkway for the main pier is installed between the two beams 6 of the main pier 1. The deck is positioned near the bottom of the triangular beams or trusses 6, so that the top longitudinal tube or railing 5 (the apex tube of the pier truss) extends along both sides of the deck at a higher elevation than the deck surface. Planks or boards 8 can then be laid along the length of the truss beams 6 sloping upwards from the deck surface so that the main deck is given a somewhat trough-shaped configuration, which acts to help to prevent people from stepping off, or losing things over the side of the pier. This provides a significant improvement in safety for the main pier.

Boats can be moored to the main pier in the spaces between the cantilever arms, by securing their lines to the tube members 4 of the truss beams 6.

Figure 4:
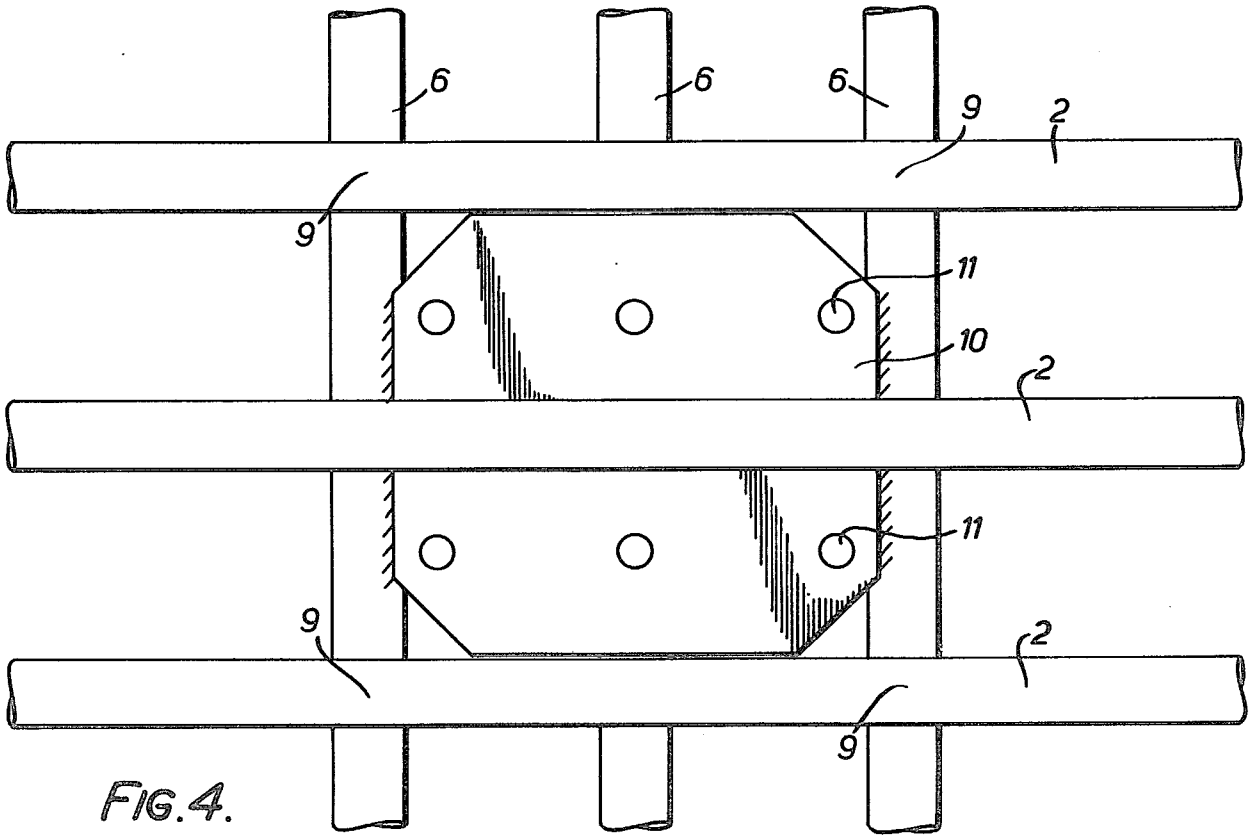
FIG. 4 is a detail sketch showing one means of fastening the beams in the main pier to the cantilevers.

FIG. 3 illustrates the way in which a cantilever beam 2 and one of the main pier beams 6 are positioned relative to one another, without showing how they are fastened together, and it will be seen that, the respective beams intersect at four points 9. In the region of these points of intersection, as shown on FIG. 4, plates 10 can be welded onto both beams 2,6, holes 11 being provided in the plates for fastening bolts. Four bolts are preferably used, and the fastening is thus extremely rigid.

A second way of fastening the two beam structures together at the four points of intersection 9 is by means of U-shaped bolt clamps 12 (See FIG. 5) Because the cantilevers are fastened to each of the main pier truss beams at four points, a very rigid structure is obtained which is able to withstand heavy wind and weather loading.

Figure 6:
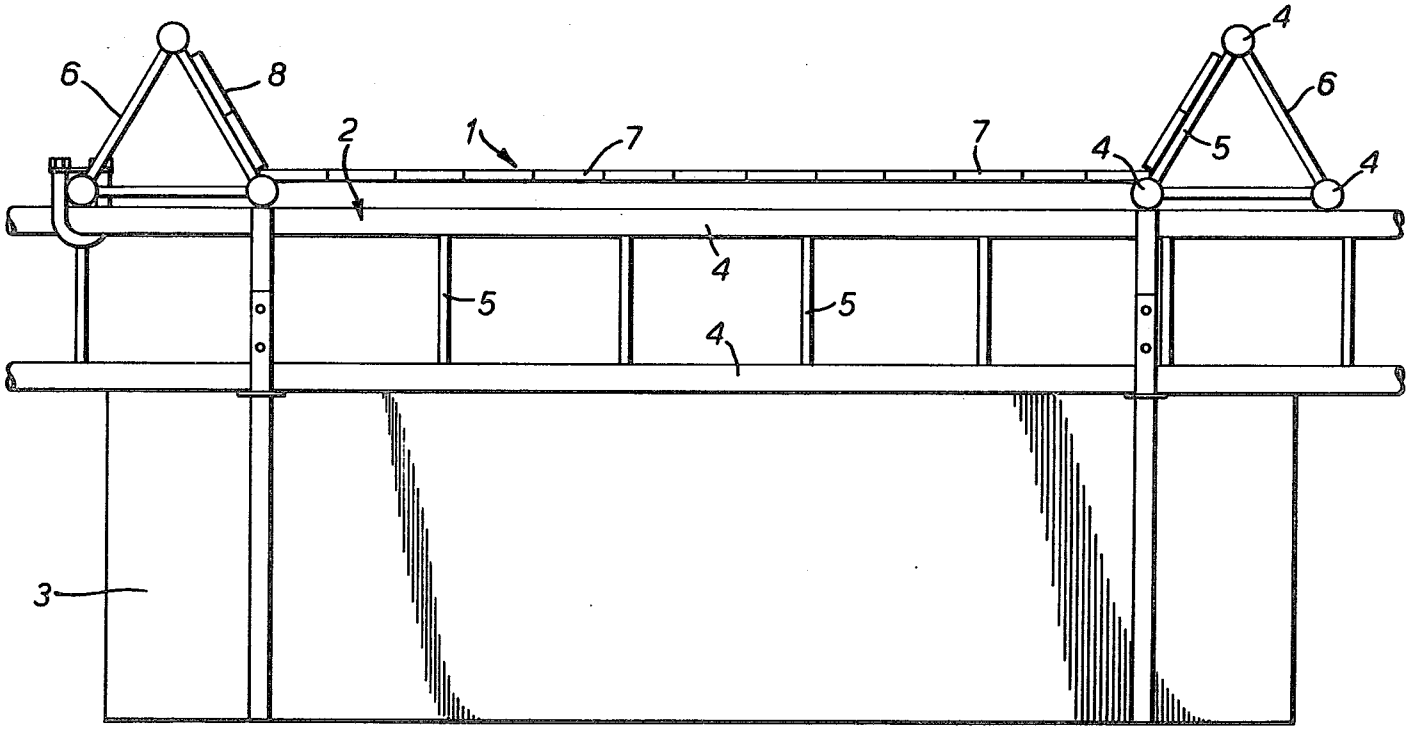
FIG. 6 shows the positioning of the main pier in cross-section.

FIG. 6 illustrates the configuration of the main pier deck. The substantial improvement in safety afforded by the upwardly-sloping edges of the pier is clearly apparent.

Fenders 13 which may be rotatable, may be provided at the outer end of each cantilever beam.

I claim:

1. A floating pier comprising at least two main pier beams, said main pier beams being oriented generally parallel one to the other, each of said main pier beams being in the form of an openwork truss member having one of a rectangular, trapezoidial and triangular cross-section, and said main pier openwork truss members each comprising at least three tubes oriented parallel one to the other, a deck mounted on and supported by main pier beams, a plurality of cantilever arms oriented transversely to said main pier beams, said cantilever arms being spaced one from another along the length of said main pier beams, each cantilever arm being of such length that it extends beneath all of said main pier beams and extends substantially beyond both side edges of an openwork truss member having one of a rectangular, trapezoidial and triangular cross-section, and said arm openwork truss members each comprising at least three tubes parallel one to the other, at least two tubes of each cantilever arm underlying and directly supporting at least two tubes of each of said main pier beams, at least four tube cross-over points thereby being established at the cross-over of each main pier beam with each cantilever arm, connectors at least partially carried by each main pier beam and at least partially carried by each cantilever arm for rigidly connecting said beams and arms together at said cross-over locations, and a series of floats connected to said cantilever arms for supporting said pier above the surface of water over which it extends.

2. A floating pier as set forth in claim 1, each of said beam openwork truss members and each of said arm openwork truss members having a triangular cross-section.

3. A floating pier as set forth in claim 2, each of said connectors, at each cross-over location, comprising a metal plate mounted to said main pier beam and a metal plate mounted to said cantilever arm, and a plurality of bolts for fastening said metal plates together, thereby rigidly connecting said beam and said arm together.

4. A floating pier as set forth in claim 2, said connectors, at each cross-over location, comprising a plurality of U-shaped clamps, each of said clamps cooperating with a main pier beam tube and a cantilever arm tube.

5. A floating pier as set forth in claim 2, at least two of said main pier beams being positioned at the side edges of said deck, said deck being configured to extend up the sides of said triangularly shaped beams.

* * * * *